US010415822B2

(12) United States Patent
Ryu et al.

(10) Patent No.: US 10,415,822 B2
(45) Date of Patent: Sep. 17, 2019

(54) APPARATUS AND METHOD FOR MEASURING HEIGHT OF SOLID BED IN HIGH-TEMPERATURE AND HIGH-PRESSURE FLUIDIZED BED SYSTEM

(71) Applicant: KOREA INSTITUTE OF ENERGY RESEARCH, Daejeon (KR)

(72) Inventors: Ho-jung Ryu, Daejeon (KR); Dong-ho Lee, Daejeon (KR); Gyoung-tae Jin, Daejeon (KR); Do-won Shun, Daejeon (KR); Chang-keun Yi, Daejeon (KR); Jae-hyeon Park, Daejeon (KR); Dal-hee Bae, Sejong-si (KR); Sung-ho Jo, Daejeon (KR); Seung-yong Lee, Daejeon (KR); Young Cheol Park, Daejeon (KR); Jong-ho Moon, Seoul (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 0 days.

(21) Appl. No.: 15/133,408

(22) Filed: Apr. 20, 2016

(65) Prior Publication Data

US 2017/0268768 A1 Sep. 21, 2017

(30) Foreign Application Priority Data

Mar. 17, 2016 (KR) ..... 10-2016-0031972

(51) Int. Cl.
*F23C 10/18* (2006.01)
*B01J 8/00* (2006.01)
(Continued)

(52) U.S. Cl.
CPC ..... *F23C 10/18* (2013.01)

(58) Field of Classification Search
CPC ..... B01J 8/00; B01J 8/18–1827; B01J 19/00; B01J 19/24; B01J 19/30; F23C 10/00; F23C 10/18
See application file for complete search history.

(56) References Cited

U.S. PATENT DOCUMENTS 4,106,210 A * 8/1978 Jukkola ..... B01J 8/0015 34/360
4,421,523 A 12/1983 Mehta
(Continued)

FOREIGN PATENT DOCUMENTS

JP 08-259612 10/1996
JP 2002-81615 3/2002
(Continued)

*Primary Examiner* — Natasha E Young
(74) *Attorney, Agent, or Firm* — Allen, Dyer, Doppelt, + Gilchrist, P.A.

(57) ABSTRACT

Disclosed are an apparatus and a method for measuring the height of a solid bed in a high-temperature and high-pressure fluidized bed system, and a fluidized bed system having the solid bed height measuring apparatus. The solid bed height measuring apparatus includes a lower pressure probe mounted at an upper side as high as a first height from a gas distributor of a fluidized bed reactor to measure pressure of the mounted location, and a middle pressure probe mounted at an upper side as high as a second height from the lower probe to measure pressure of the mounted location. An upper pressure probe is mounted at the top of the fluidized bed reactor to measure the inside pressure of the fluidized bed reactor. First and second differential pressure gauges are used for measuring differential pressures.

5 Claims, 9 Drawing Sheets

(51) Int. Cl.

| | |
|---|---|
| ***B01J 8/18*** | (2006.01) |
| ***B01J 19/00*** | (2006.01) |
| ***B01J 19/24*** | (2006.01) |
| ***B01J 19/30*** | (2006.01) |

(56) References Cited

U.S. PATENT DOCUMENTS 6,013,741 A * 1/2000 Ohtani ..... B01J 8/1809
526/82
6,111,034 A * 8/2000 Goode ..... C08F 10/00
526/161

FOREIGN PATENT DOCUMENTS

| | | |
|---|---|---|
| JP | 2003056808 | 2/2003 |
| JP | 2002081615 | 3/2003 |
| KR | 2002-0049907 | 11/2002 |
| KR | 2013-0046868 | 10/2011 |

* cited by examiner

APPARATUS AND METHOD FOR MEASURING HEIGHT OF SOLID BED IN HIGH-TEMPERATURE AND HIGH-PRESSURE FLUIDIZED BED SYSTEM

CROSS REFERENCE TO RELATED APPLICATIONS

This application claims priority to Korean Patent Application Serial No. KR10-2016-0031972, filed on Mar. 17, 2016.

FIELD OF THE INVENTION

The present invention relates to an apparatus and a method for measuring the height of a solid bed in a high-temperature and high-pressure fluidized bed system and a fluidized bed system having the solid bed height measuring apparatus.

BACKGROUND OF THE INVENTION

In general, a gas-solid fluidized bed (hereinafter, called a 'fluidized bed') system has a structure that the inner space of the fluidized bed system is divided into an upper space and a lower space by a gas distributor 1 mounted therein to inject gas into the lower space and the gas injected through the gas distributor 1 by gas injection means or gas injector 3 is introduced into a plenum 2 and dispersed evenly so that particulate materials flow in the upper space. The lower space of the gas distributor 1 is called a 'plenum' or a 'wind box'.

FIG. 1 is a configurative diagram of a conventional fluidized bed system for showing a differential pressure measurement method in a fluidized bed. As shown in FIG. 1, in order to measure flow characteristics of gas and solid inside the fluidized bed 10, a difference between pressure of the lower space of the fluidized bed 10 and atmospheric pressure is measured.

That is, temperature is measured in real time by a temperature sensor 4 immersed inside the fluidized bed 10, and a lower end of a pressure probe 5 is located at a lower end of the inside of the fluidized bed 10 to measure a difference between pressure of the lower space of the fluidized bed 10 and atmospheric pressure.

In such a system, a fluidized state is formed when fluidization gas of an appropriate amount is evenly injected to a container, which is filled with solid, by the gas distributor 1.

FIG. 2 is a graph showing changes in fluidization region and pressure drop (differential pressure) of the solid bed according to velocity of fluidization gas. As shown in FIG. 2, if the flow velocity is low, gas simply flows spaces among solid particles and there is little movement of solid due to the flow of the gas.

A particle layer of such a state is called a 'fixed bed'. In this instance, as gas speed is increased, pressure drop at the solid bed is also increased until it becomes equal to the weight of the solid bed. If the pressure drop becomes equal to the weight of the solid bed, drag force applied to solid by gas becomes equal to gravity, and particles start to be shaken and move from each other.

Such a state is called the minimum fluidization condition, and in this instance, superficial gas velocity is called the minimum fluidization velocity ($U_{mf}$).

After that, when the gas velocity increases continuously, the pressure drop remains nearly steady, but the solid bed is expanded, the particles are separated from each other to move and the bed generally starts to have characteristics of liquid. Excess gas passes the bed in the form of a large void. The large void is called bubble similarly to a gas-liquid system, the gas velocity that a bubble is formed at the first is called the minimum bubbling velocity, and the fluidized bed where such a phenomenon happens is called a bubbling fluidized bed.

In the meantime, in case of a high-pressure fluidized bed process carried out at high pressure, as shown in FIG. 1, if one end of the pressure probe 5 of a differential pressure gauge is mounted at the lower portion of the solid bed and the other end is exposed to the air, it is impossible to measure differential pressure because there is a great difference between the inside pressure of a fluidized bed reactor and atmospheric pressure.

FIG. 3 is a configurative diagram of a conventional fluidized bed system showing a method for measuring differential pressure using two pressure probes. As shown in FIG. 3, because the two probes 5 of a differential pressure gauge 6 are all mounted inside the fluidized bed, the probe immersed in the solid bed measures the sum of pressure of the system and head by particles existing at the upper part of the probe 5, and the probe 5 which is not immersed in the solid bed measures pressure of the system. Therefore, the conventional fluidized bed system uses the method for measuring only pressure drop by the particles due to a difference between the two measured values.

In general, one of the probes 5 of the differential pressure gauge 6, the probe of high pressure, namely, high point marked with + is mounted at the lower part of the fluidized bed, and the probe having low pressure, namely, low point marked with − is mounted at the upper part of the fluidized bed in order to measure a differential pressure formed by the solid bed.

Meanwhile, because pressure applied to the probe is increased if the height of the solid bed existing at the upper part of the pressure probe 5 for measuring the differential pressure which is illustrated in FIG. 1 is increased, the differential pressure is also increased. Moreover, as shown in FIG. 3, if the height of the solid bed existing between the (+) probe 5 and the (−) probe 5 is increased, pressure applied to the (+) probe 5 is increased but there is no change in pressure applied to the (−) probe 5 such that the differential pressure is increased. As described above, using the characteristics that the differential pressure is increased as the height of the solid bed is increased, the high-temperature and high-pressure fluidized bed system of which the inside is invisible measures the differential pressure to infer the height of the solid bed inside the fluidized bed.

In order to calculate the height (H) of the solid bed using the differential pressure measured under the bubbling fluidized bed condition, the following mathematical formula 1 is generally used.

$$H = \frac{\Delta P}{(1-\varepsilon_{mf})(\rho_s-\rho_g)} \frac{g_c}{g} \qquad \text{Mathematical Formula 1}$$

wherein H is height (m) of the solid bed under the fluidization condition, ΔP is a pressure drop (differential pressure) [Pa] by the solid bed, $\varepsilon_{mf}$ is a voidage [−] of the solid bed under the minimum fluidization condition, $\rho_s$ is density [kg/m$^3$] of solid, $\rho_g$ is density [kg/m$^3$] of gas, $g_c$ is a gravitational acceleration constant, 1 [(kgm)/(Ns$^2$)], and g is acceleration of gravity, 9.8 [m/s$^2$].

As shown in the mathematical formula 1, in order to calculate the height of the solid bed using the differential pressure measured in the fluidized bed, various properties, such as the voidage of the solid bed under the minimum fluidization condition, the density of solid and the density of gas, are needed, and especially, in case that temperature and pressure are changed, the density of gas is also changed. Therefore, it is possible to calculate the height of the solid bed only when a correct value of the density of gas is given.

Furthermore, it is difficult to correctly measure the voidage of the minimum fluidization condition because the voidage of the minimum fluidization condition is varied according to the size of particles, sphericity, temperature, pressure and so on.

Additionally, because the density of solid is varied according to reaction time when the size and components of particles are varied by reaction inside the fluidized bed, it is difficult to exactly measure the height of the solid bed.

Finally, through the conventional method for measuring differential pressure in the high-temperature and high-pressure fluidized bed reactor accompanying reaction, it is difficult to exactly measure the height of the solid bed.

SUMMARY OF THE INVENTION

Accordingly, the present invention has been made in view of the above-mentioned problems occurring in the prior art, and it is an object of the present invention to provide an apparatus and a method for measuring the height of a solid bed in a high-temperature and high-pressure fluidized bed system and a fluidized bed system having the solid bed height measuring apparatus, which can exactly measure a height of a solid bed inside a fluidized bed without needing a complex formula even though density of particles is changed by a reaction in case that temperature and pressure are varied.

It is another object of the present invention to provide an apparatus and a method for measuring the height of a solid bed in a high-temperature and high-pressure fluidized bed system and a fluidized bed system having the solid bed height measuring apparatus, which can measure the height of the solid bed more exactly because there is no difference by consumption or generation of gas, temperature change, bubble rise and so on due to a first differential pressure gauge and a second differential pressure gauge which have the same (+) side.

Technical objects to be achieved by the present invention are not limited to the above-described objects and other technical objects that have not been described will be evidently understood by those skilled in the art from the following description.

To accomplish the above objects according to the present invention, in the first aspect of the present invention, there is provided a solid bed height measuring apparatus in a high-temperature and high-pressure fluidized bed system including: a lower pressure probe which is mounted at an upper side as high as a first height from a gas distributor of a fluidized bed reactor to measure pressure of the mounted location; a middle pressure probe which is mounted at an upper side as high as a second height from the lower probe to measure pressure of the mounted location; an upper pressure probe which is mounted at the top of the fluidized bed reactor to measure the inside pressure of the fluidized bed reactor; a first differential pressure gauge for measuring a first differential pressure value which is differential pressure between a first pressure value measured by the lower pressure probe and a second pressure value measured by the middle pressure probe; and a second differential pressure gauge for measuring a second differential pressure value which is differential pressure between a first pressure value measured by the lower pressure probe and a third pressure value measured by the upper pressure probe.

Moreover, the solid bed height measuring apparatus further includes a height arithmetic part for calculating a height of the solid bed inside the fluidized bed reactor based on the first differential pressure value and the second differential pressure value.

Furthermore, the lower pressure probe and the middle pressure probe exist inside the solid bed under all operation conditions, and the upper pressure probe is mounted at the upper side of the fluidized bed reactor, where the solid bed cannot reach, under all operation conditions.

Additionally, the height arithmetic part calculates a height arithmetic constant value from the first differential pressure value and the second height.

In addition the height arithmetic part calculates the height of the solid bed of the fluidized bed reactor based on the height arithmetic constant value, the second differential pressure value and the first height.

In the second aspect of the present invention, there is provided a solid bed height measuring method inside a fluidized bed reactor including the steps of: mounting a lower pressure probe at an upper side as high as a first height from a gas distributor of a fluidized bed reactor, mounting a middle pressure probe at an upper side as high as a second height from the lower probe and mounting an upper pressure probe at the top of the fluidized bed reactor; injecting fluidization gas into a gas introducing chamber below the gas distributor; measuring pressure values by the lower pressure probe, the middle pressure probe and the upper pressure probe; measuring a first differential pressure value, which is a differential pressure between a first pressure value measured by the lower pressure probe and a second pressure value measured by the middle pressure probe, by a first differential pressure gauge and a second differential pressure value, which is a differential pressure between a first pressure value measured by the lower pressure probe and a third pressure value measured by the upper pressure probe, by a second differential pressure gauge; and calculating a height of the solid bed inside the fluidized bed reactor based on the first differential pressure value and the second differential pressure value by a height arithmetic part.

Moreover, in the step of calculating the height of the solid bed, the height arithmetic part calculates a height arithmetic constant value from the first differential pressure value and the second height.

Furthermore, the height arithmetic part calculates the height of the solid bed of the fluidized bed reactor based on the height arithmetic constant value, the second differential pressure value and the first height.

In the third aspect of the present invention, there is provided a high-temperature and high-pressure fluidized bed system comprising the solid bed height measuring apparatus according to the first aspect of the present invention described above.

In the fourth aspect of the present invention, there is provided a solid bed height measuring apparatus in a high-temperature and high-pressure fluidized bed system including: a lower pressure probe which is mounted at an upper side as high as a first height from a gas distributor of a fluidized bed reactor to measure pressure of the mounted location; a middle pressure probe which is mounted at an upper side as high as a second height from the lower probe to measure pressure of the mounted location; an upper pressure probe which is mounted at the top of the fluidized bed reactor to measure the inside pressure of the fluidized bed reactor; a differential pressure type pressure converter for measuring differential pressure values a first pressure value measured by the lower pressure probe, a second pressure value measured by the middle pressure probe and a third pressure value measured by the upper pressure probe; and a height arithmetic part for calculating a height of the solid bed inside the fluidized bed reactor based on the differential pressure value measured by the differential pressure type pressure converter.

Additionally, the differential pressure type pressure converter measures a first differential pressure value which is a differential pressure between the first pressure value and the second pressure value, and the height arithmetic part calculates a height arithmetic constant value from the first differential pressure value and a second height.

In addition, the differential pressure type pressure converter measures a second differential pressure value which is a differential pressure between the first pressure value and the third pressure value, and the height arithmetic part calculates a height of the solid bed from the second differential pressure value and a first height.

In the fifth aspect of the present invention, there is provided a solid bed height measuring method inside a fluidized bed reactor including the steps of: mounting a lower pressure probe at an upper side as high as a first height from a gas distributor of a fluidized bed reactor, mounting a middle pressure probe at an upper side as high as a second height from the lower probe and mounting an upper pressure probe at the top of the fluidized bed reactor; injecting fluidization gas into a gas introducing chamber below the gas distributor; measuring pressure values by the lower pressure probe, the middle pressure probe and the upper pressure probe; measuring a first differential pressure value, which is a differential pressure between a first pressure value measured by the lower pressure probe and a second pressure value measured by the middle pressure probe, and a second differential pressure value, which is a differential pressure between the first pressure value measured by the lower pressure probe and a third pressure value measured by the upper pressure probe, by a differential pressure type pressure converter; and calculating a height arithmetic constant value from the first differential pressure value and the second height and calculating a height of the solid bed from the second differential pressure value and the first height.

In the second aspect and the fourth aspect of the present invention, the lower pressure probe and the middle pressure probe exist inside the solid bed under all operation conditions, and the upper pressure probe is mounted at the upper side of the fluidized bed reactor, where the solid bed cannot reach, under all operation conditions.

In the first aspect and the third aspect of the present invention, the solid bed height measuring apparatus further includes a display part for displaying the first pressure value, the second pressure value, the third pressure value, the first differential pressure value, the second differential pressure value and the height of the solid bed in real time.

In the sixth aspect of the present invention, there is provided a high-temperature and high-pressure fluidized bed system including the solid bed height measuring apparatus according to the third aspect of the present invention described above.

According to the embodiment of the present invention, the solid bed height measuring apparatus and method and the fluidized bed system having the solid bed height measuring apparatus can exactly measure the height of the solid bed inside the fluidized bed without needing any complex formula even though density of particles is changed by a reaction in case that temperature and pressure are varied.

Additionally, according to the embodiment of the present invention, the solid bed height measuring apparatus and method and the fluidized bed system having the solid bed height measuring apparatus can measure the height of the solid bed more exactly because there is no difference by consumption or generation of gas, temperature change, bubble rise and so on due to a first differential pressure gauge and a second differential pressure gauge which have the same (+) side.

Technical effects that can be obtained through the present invention are not limited to the above-described effects and other technical effects that have not been described will be evidently understood by those skilled in the art from the following description.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION

Figure 1:
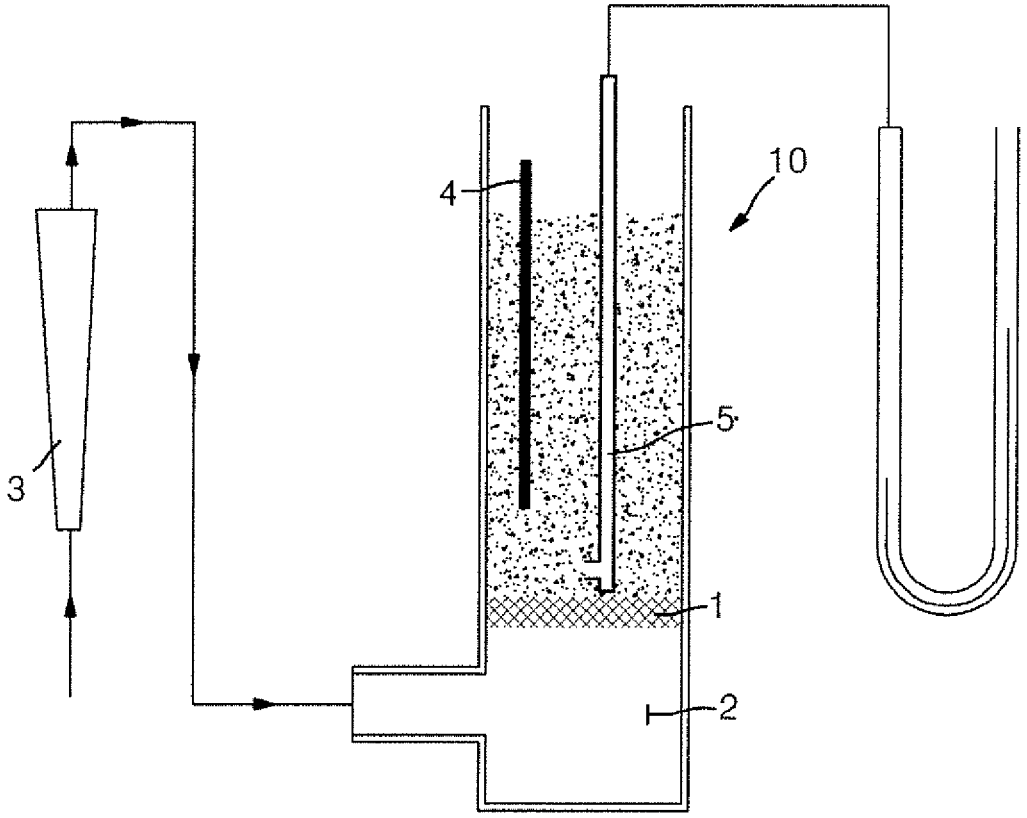
FIG. 1 is a configurative diagram of a conventional fluidized bed system for showing a differential pressure measurement method in a fluidized bed.
Figure 2:
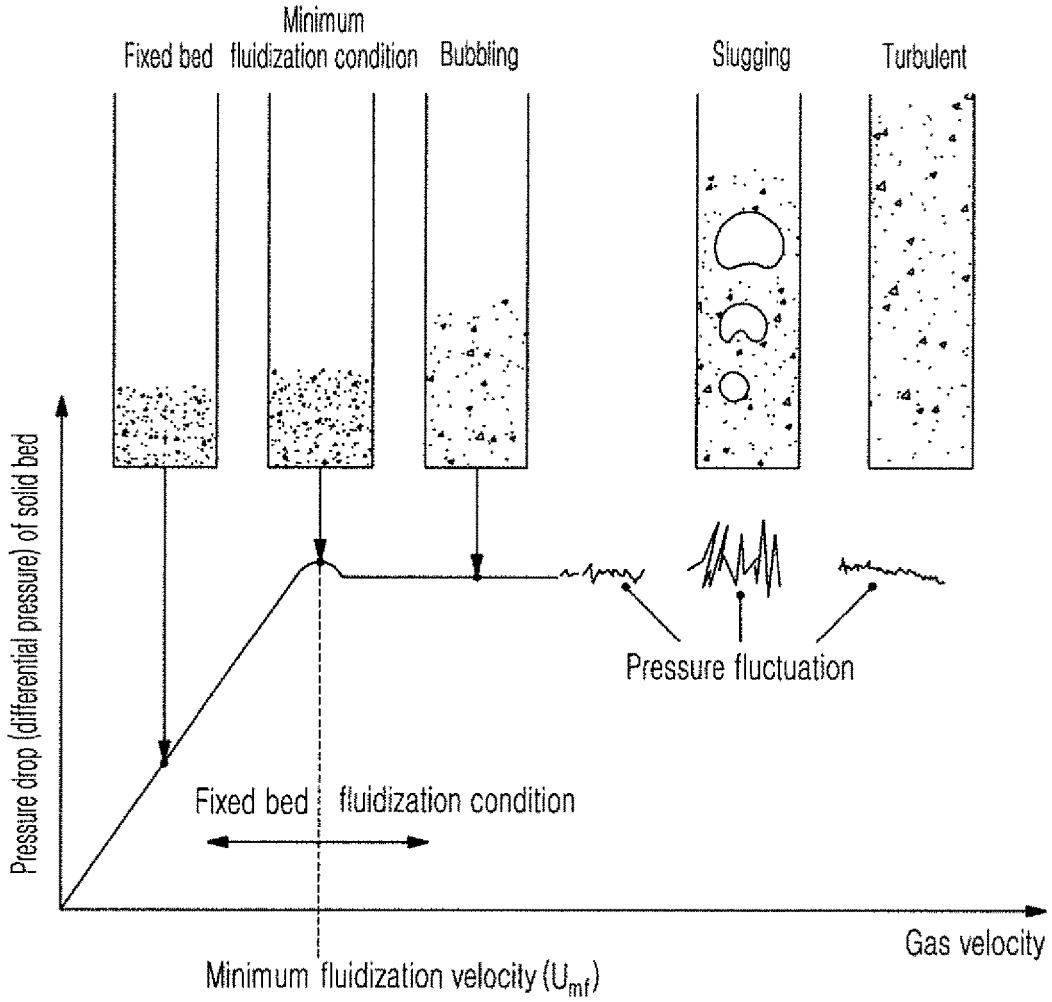
FIG. 2 is a graph showing a change in pressure drop (differential pressure) of a fluidization region and a solid bed according to the velocity of fluidization gas.
Figure 3:
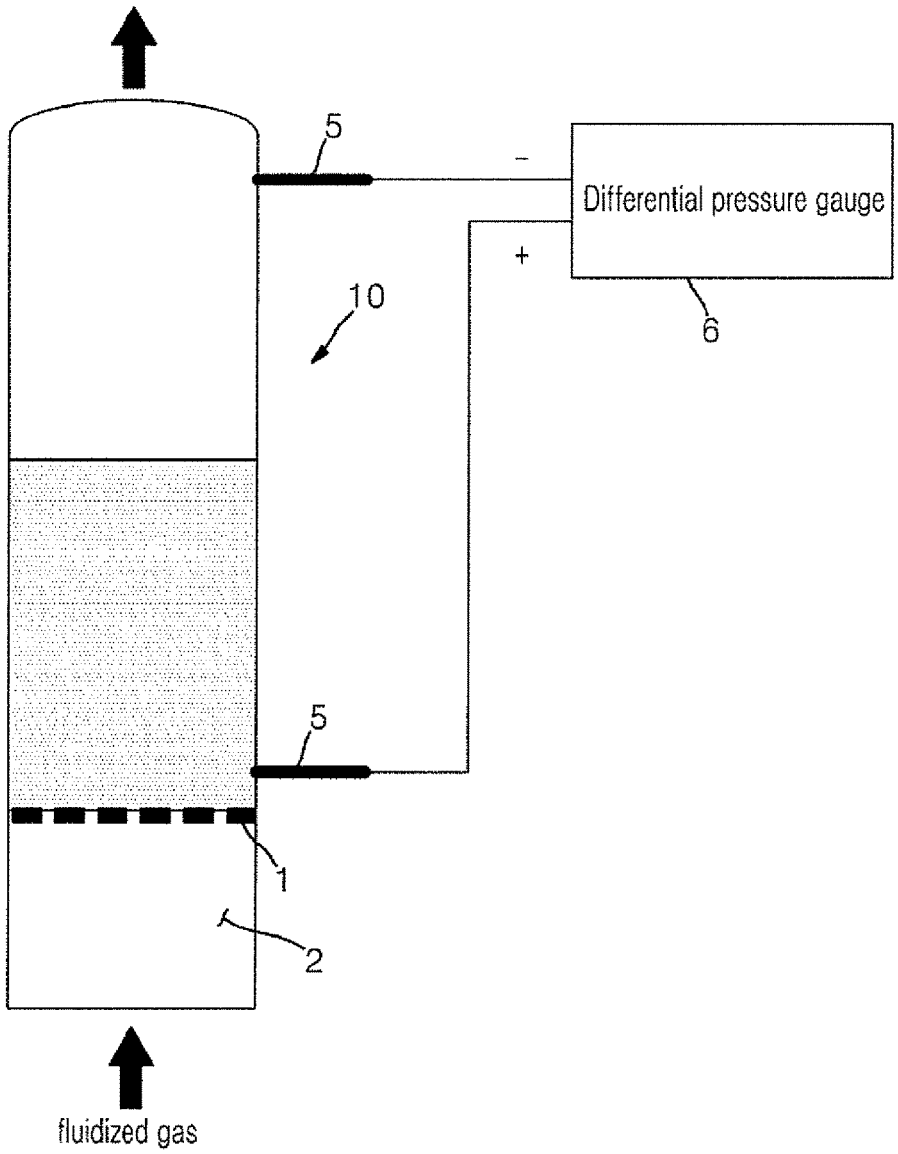
FIG. 3 is a configurative diagram of a conventional fluidized bed system showing a method for measuring differential pressure using two pressure probes.

The objects, features, and advantageous of the present invention will be described in detail through the following preferable exemplary embodiments with reference to the accompany drawings. As those skilled in the art would realize, the described embodiments may be modified in various different ways, all without departing from the spirit or scope of the present invention. On the contrary, exemplary embodiments introduced herein are provided to make disclosed contents thorough and complete and to sufficiently transfer the spirit of the present invention to those skilled in the art.

It will be understood that, when an element is referred to as being on another element, the element can be directly on the other element, or intervening elements may be present. Further, in the drawings, the sizes of elements may be exaggerated for effective description of technical contents.

Exemplary embodiments in the specification will be described with reference to cross-sectional views and/or plan views which are ideal exemplary views of the present invention. In addition, the size and thickness of film and areas shown in the drawings are arbitrarily shown for understanding and ease of description, but the present invention is not limited thereto. Thus, the exemplary views may be modified due to manufacturing methods and/or a permissible error. Therefore, the exemplary embodiments of the present invention are not limited to the shapes shown in the drawings but include variation of the shape depending on a manufacturing process. For example, an etching area illustrated as a right angle may be rounded or have a predetermined curvature. Thus, the areas exemplarily illustrated in the drawings have characteristics, and the shape of the areas shown in the drawings exemplarily illustrates specific shapes, but the present invention is not limited thereto. In the various exemplary embodiments of the specification, the terms, "first", "second", and the like are used to describe various constituent elements, but the constituent elements are not limited to the terms. The terms are used only to distinguish one constituent element from other. The exemplary embodiments described and exemplarily illustrated herein include complementary exemplary embodiments.

Terms used in the specification are provided for description of the exemplary embodiments, and the present invention is not limited thereto. In the specification, singulars in sentences include plural unless otherwise noted. It will be understood in the specification that the terms "comprises" and "comprising", when used herein, specify the presence of constituent elements, but do not preclude the presence or addition of other constituent elements.

The following constitutions described in the Examples and the Comparative Examples are provided for better understanding of the present invention. However, a person skilled in the art can recognize that the present invention can be used without description of the contents. Parts that are well known and irrelevant to the present invention will be omitted in description of the present invention to prevent confusion in understanding of the present invention.

Hereinafter, the structure and the functions of a high-temperature and high-pressure fluidized bed system 100 having a solid bed height measuring apparatus according to a first preferred embodiment of the present invention will be described.

Figure 4:
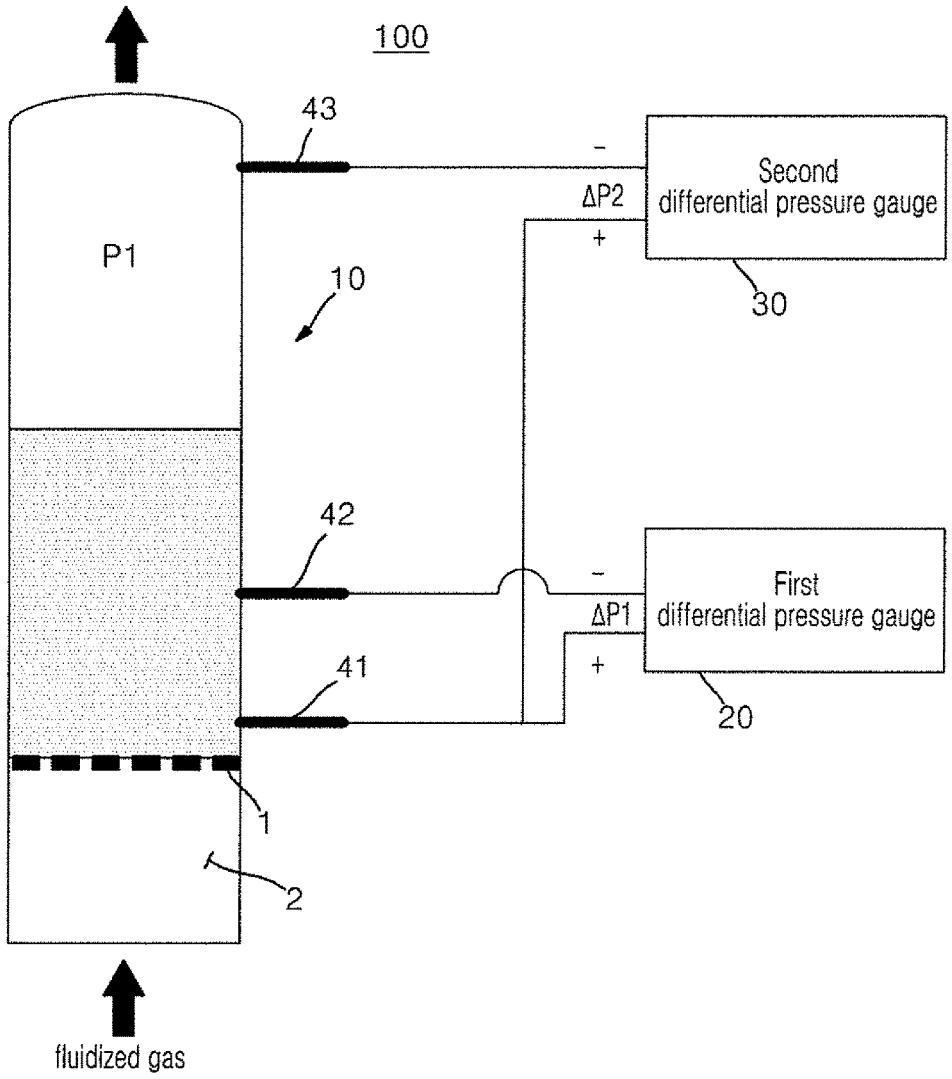
FIGS. 4 and 5 are configurative diagrams of a high-temperature and high-pressure fluidized bed system having a solid bed height measuring apparatus according to a first preferred embodiment of the present invention.
Figure 5:
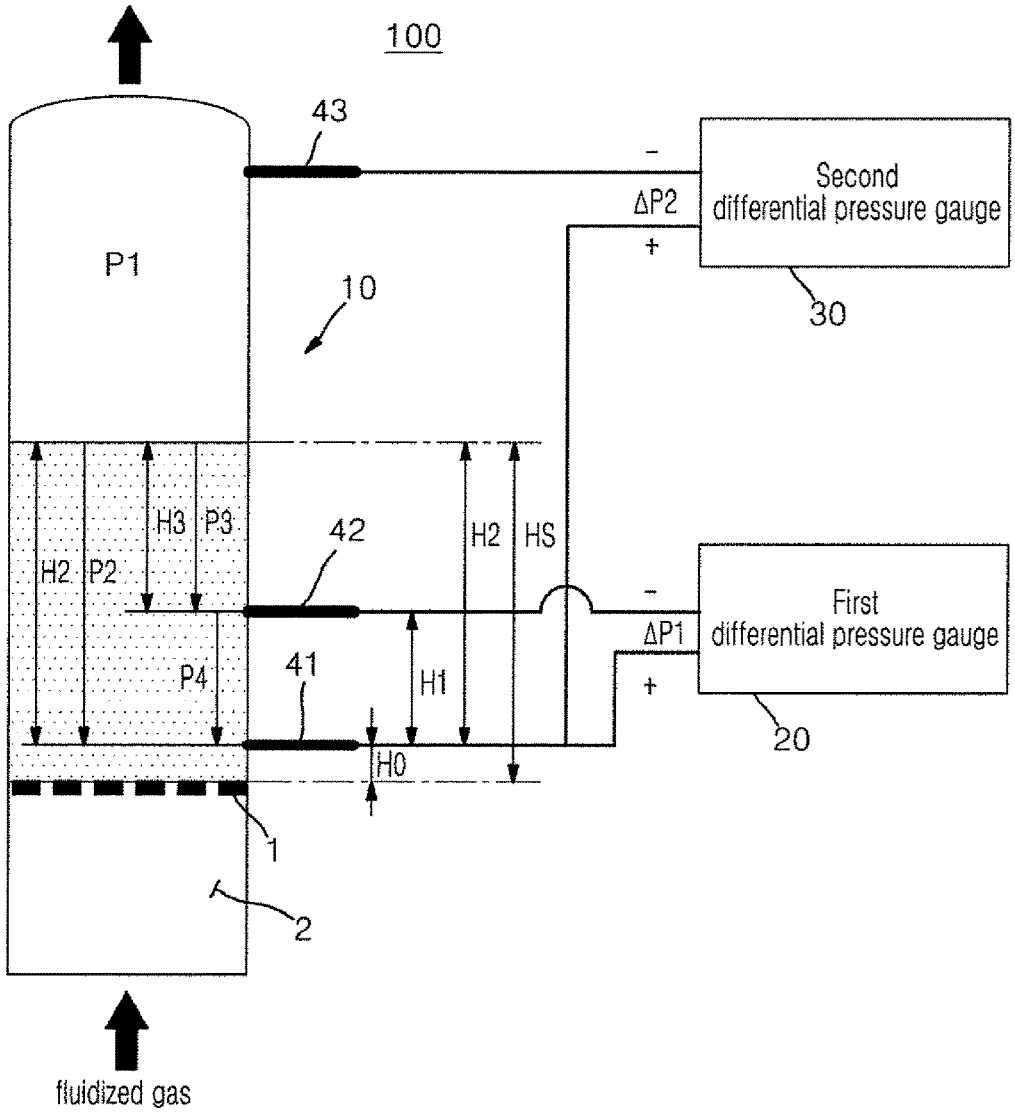

FIGS. 4 and 5 are configurative diagrams of the high-temperature and high-pressure fluidized bed system having the solid bed height measuring apparatus.

As shown in FIGS. 4 and 5, the solid bed height measuring apparatus of the high-temperature and high-pressure fluidized bed system according to the first preferred embodiment includes a lower pressure probe 41, a middle pressure probe 42, an upper pressure probe 43, a first differential pressure gauge 20, a second differential pressure gauge 30 and so on.

The lower pressure probe 41 is mounted at an upper side as high as a first height from a gas distributor 1 of a fluidized bed reactor 10 to measure pressure of the mounted location. Moreover, the middle pressure probe 42 is mounted at the upper side as high as a second height from the lower pressure probe 41 to measure pressure of the mounted location. On the other hand, the upper pressure probe 43 is mounted at the top of the fluidized bed reactor 10 to measure the inside pressure of the fluidized bed reactor 10.

The lower pressure probe 41 and the middle pressure probe 42 exist inside the solid bed under all operation conditions, and the upper pressure probe 43, under all operation conditions, is mounted at the upper side of the fluidized bed reactor 10 where the solid bed cannot reach.

Furthermore, the first differential pressure gauge 20 is connected with the lower pressure probe 41 and the middle pressure probe 42 to measure a first differential pressure value which is a differential pressure obtained between a first pressure value measured by the lower pressure probe 41 and a second pressure value measured by the middle pressure probe 42.

Additionally, the second differential pressure gauge 30 is connected with the lower pressure probe 41 and the upper pressure probe 43 to measure a second differential pressure value which is a differential pressure obtained between the first pressure value measured by the lower pressure probe 41 and a third pressure value measured by the upper pressure probe 43.

In addition, a height arithmetic part which will be described later in detail calculates the height of the solid bed inside the fluidized bed reactor 10 based on the first differential pressure value and the second differential pressure value.

A (+) side of the first differential pressure gauge 20 is connected with the lower pressure probe 41 and a (−) part is connected with the middle pressure probe 42. A (+) side of the second differential pressure gauge 30 is connected with the lower pressure probe 41 and a (−) part is connected with the upper pressure probe 43. That is, the lower pressure probe is shared between the first differential pressure gauge 20 and the second differential pressure gauge 30.

Hereinafter, a method for calculating and measuring the height of the solid bed according to the first preferred embodiment of the present invention will be described. The height arithmetic part according to the first preferred embodiment calculates a height arithmetic constant value from the first differential pressure value and the second height, and then, arithmetically operates the height of the solid bed of the fluidized bed reactor 10 based on the height arithmetic constant value, the second differential pressure value and the first height value.

In more detail, the first differential pressure value measured by the first differential pressure gauge 20 is a difference between the first pressure value measured by the lower pressure probe 41 which is the (+) side of the first differential pressure gauge 20 and the second pressure value measured by the middle pressure probe 42 which is the (+) side. The pressure measured by the lower pressure probe 41 is the sum of the inside pressure (P1) of the fluidized bed and the pressure (P2) by a height (H2) of the solid bed existing at the upper part of the lower pressure probe 41, and the second pressure value measured by the middle pressure probe 42 is the sum of the inside pressure (P1) of the fluidized bed and the pressure (P3) by a height (H3) of the solid bed existing at the upper part of the middle pressure probe 42.

Therefore, the first differential pressure value measured by the first differential pressure gauge 20 corresponds to a pressure drop (P4) by the solid bed equivalent to a height of H1. It can be arranged as follows:

pressure measured by the lower pressure probe 41 which is the (+) side of the first differential pressure gauge 20=P1+P2; and pressure measured by the middle pressure probe 42 which is the (−) side of the first differential pressure gauge 20=P1+P3.

Moreover, the pressure drop (ΔP1) measured by the first differential pressure gauge 20 is as follows:

$\Delta P1$=Pressure measured by the lower pressure probe 41 of the (+) side—Pressure measured by the middle pressure probe 42 of the (−) side $=(P1+P2)-(P1+P3)$ $=P2-P3$ $=P4$ =Pressure drop by the solid bed equivalent to the height of $H1(=H2-H3)$.

In the meantime, the second differential pressure measured by the second differential pressure gauge 30 is a difference between the first pressure value measured by the lower pressure probe 41 of the (+) side and the third pressure value measured by the upper pressure probe 43 of the (−) side, the first pressure measured by the lower pressure probe 41 of the (+) side is the sum of the inside pressure (P1) of the fluidized bed and the pressure (P2) by the solid bed existing at the upper part of the lower pressure probe 41, and the third pressure value measured by the upper pressure probe 43 of the (−) side is the inside pressure (P1) of the fluidized bed.

Therefore, the second differential pressure value measured by the second differential pressure gauge 30 corresponds to a pressure drop by the solid matter equivalent to a height of H2. It can be arranged as follows:

pressure measured by the lower pressure probe 41 which is the (+) side of the second differential pressure gauge 30=P1+P2; and pressure measured by the upper pressure probe 43 which is the (−) side of the second differential pressure gauge 30=P1.

The pressure drop (ΔP2) measured by the second differential pressure gauge 30 is as follows:

$\Delta P2$=Pressure measured by the lower pressure probe 41 of the (+) side—Pressure measured by the upper pressure probe 43 of the (−) side $=(P1+P2)-(P1)=P2$ =Pressure drop by the solid bed equivalent to the height of $H2$.

As described above, in case that the first differential pressure gauge 20 and the second differential pressure gauge 30 which are different from each other are used, even though the entire height (HS) of the solid bed is changed, if the lower pressure probe 41 and the middle pressure probe 42 which are connected with the first differential pressure gauge 20 exist inside the solid bed, the distance (H2) between the lower pressure probe 41 and the middle pressure probe 42 is the previously known constant value and the first differential pressure value measured by the first differential pressure gauge 20 is also constant.

Therefore, the mathematical formula 1 described in 'Background Art' can be expressed as the following mathematical formula 2.

$$H = \frac{g_c}{(1-\varepsilon_{mf})(\rho_s-\rho_g)g}\Delta P \qquad \text{Mathematical Formula 2}$$

In the mathematical formula 2, considering $$a = \frac{g_c}{(1-\varepsilon_{mf})(\rho_s-\rho_g)g},$$

the mathematical formula 2 can be expressed as the following mathematical formula 3.

$$H=a\Delta P \qquad \text{Mathematical Formula 3}$$

Therefore, the distance (H1) between the lower pressure probe 41 and the middle pressure probe 42 can be expressed as the following mathematical formula 4 if the first differential pressure value (ΔP1) measured by the first differential pressure gauge 20 is substituted in the mathematical formula 3, and the height arithmetic constant value (a) can be calculated using the first differential pressure value and the distance (H1) between the lower pressure probe 41 and the middle pressure probe 42.

$$H1=a\Delta P1 \qquad \text{Mathematical Formula 4}$$

Moreover, because the value (a) at the same time is constant regardless of the measured height, if the previously calculated value (a) and the second differential pressure value (ΔP2) measured by the second differential pressure gauge 30 is substituted in the following mathematical formula 5, the height (H2) of the solid bed existing at the upper part of the lower pressure probe 41 can be calculated.

$$H2=a\Delta P2 \qquad \text{Mathematical Formula 5}$$

Furthermore, the entire height (HS) of the solid bed existing at the upper part of the gas distributor 1 can be obtained through the sum of H0 and H2 as shown in the following mathematical formula 6 because the distance (H0) between the gas distributor 1 and the lower pressure probe 41 has been known.

$$HS=H0+H2 \qquad \text{Mathematical Formula 6}$$

Hereinafter, a solid bed height measuring apparatus of a high-temperature and high-pressure fluidized bed system according to a second preferred embodiment of the present invention will be described. First, FIG. 6 is a configurative diagram of the high-temperature and high-pressure fluidized bed system having the solid bed height measuring apparatus according to the second preferred embodiment of the present invention.

Figure 6:
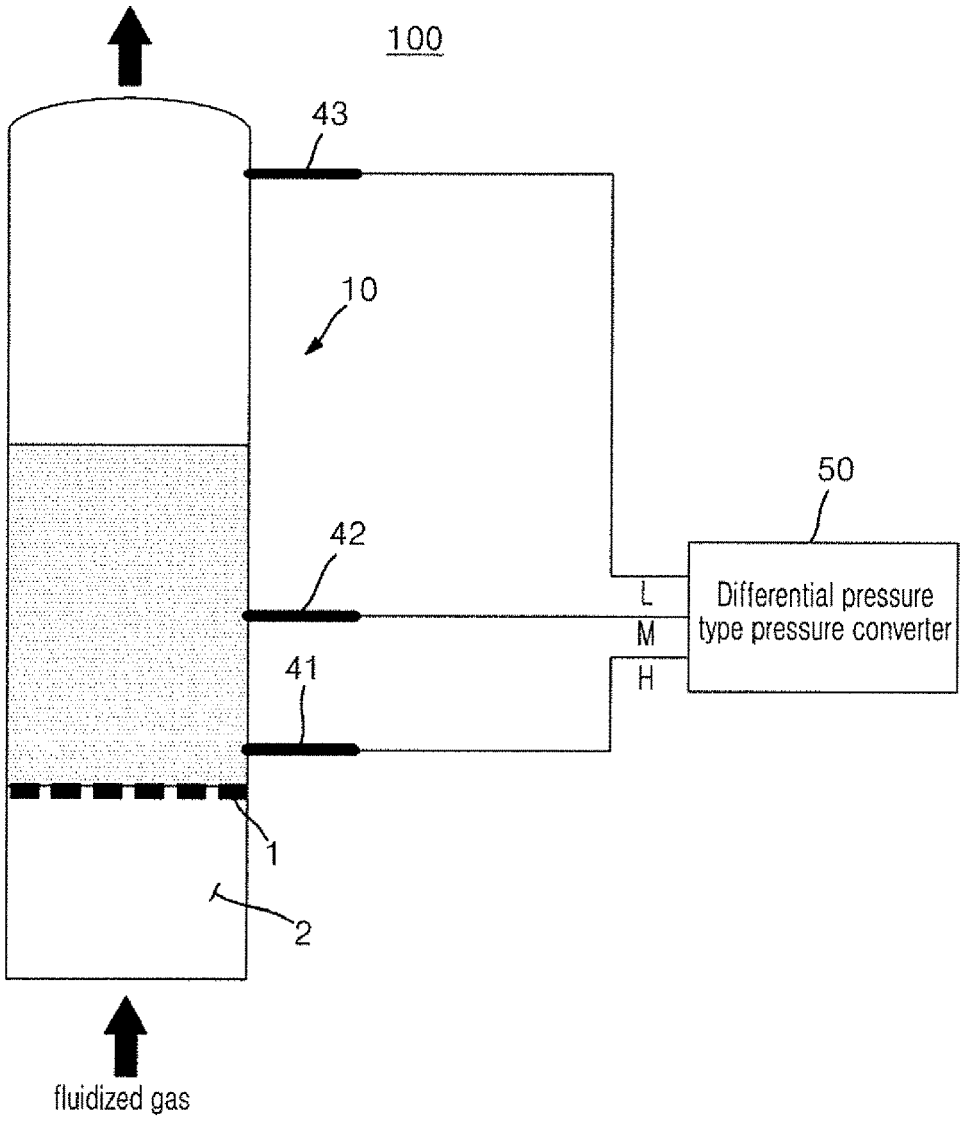
FIG. 6 is a configurative diagram of a high-temperature and high-pressure fluidized bed system having a solid bed height measuring apparatus according to a second preferred embodiment of the present invention.

In the second preferred embodiment, instead of the first differential pressure gauge 20 and the second differential pressure gauge 30 according to the first preferred embodiment, as shown in FIG. 6, one differential pressure type pressure converter 50 may be included. The differential pressure type pressure converter 50 is connected to all of the lower pressure probe 41, the middle pressure probe 42 and the upper pressure probe 43.

Therefore, the differential pressure type pressure converter 50 measure a differential pressure value using the first pressure value measured by the lower pressure probe 41, the second pressure value measured by the middle pressure probe 42 and the third pressure value measured by the upper pressure probe 43.

The differential pressure type pressure converter 50 measures the first differential pressure value from a difference between the first pressure value measured by the lower pressure probe 41 and the second pressure value measured by the middle pressure probe 42, and as described above, the height arithmetic part calculates a height arithmetic constant value using the first differential pressure value and the previously known height arithmetic constant value between the lower pressure probe 41 and the middle pressure probe 42.

Furthermore, the differential pressure type pressure converter 50 measures a second differential pressure value which is a difference between the first pressure value measured by the lower pressure probe 41 and the third pressure value measured by the upper pressure probe 43, and the height arithmetic part calculates a height of the solid bed existing at the upper part of the lower pressure probe 41 based on the measured second differential pressure value and the height arithmetic constant value, and then, calculate a height of the solid bed by adding up the height value and the previously known distance between the gas distributor 1 and the lower pressure probe 41.

Additionally, each of the solid bed height measuring apparatuses according to the first and second preferred embodiments of the present invention may include a display part for displaying the first pressure value, the second pressure value, the third pressure value, the first differential pressure value, the second differential pressure value and the height of the solid bed in real time.

EXPERIMENTAL EXAMPLE

Hereinafter, an experimental example using the measuring apparatus according to the preferred embodiment of the present invention described above will be described.

Figure 7A:
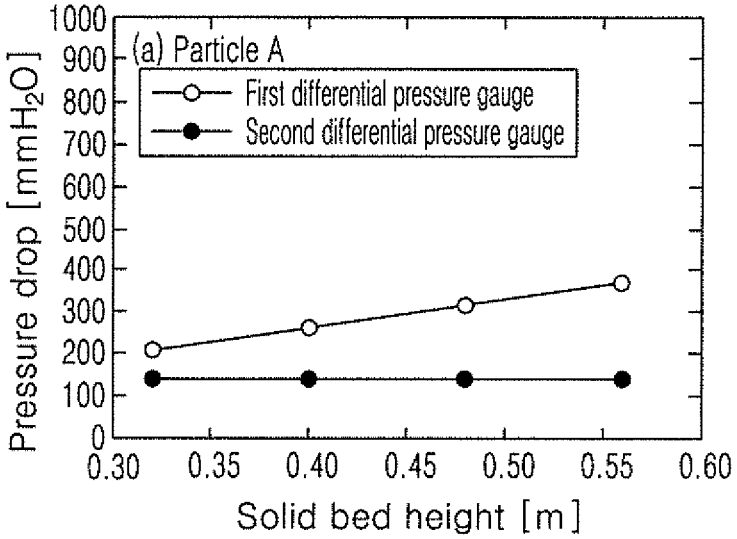
FIGS. 7*a* to 7*c* are graphs showing changes in measured values of a first differential pressure measuring part and a second differential pressure measuring part measured in connection with three different particles according to an experimental example of the present invention.
Figure 7B:
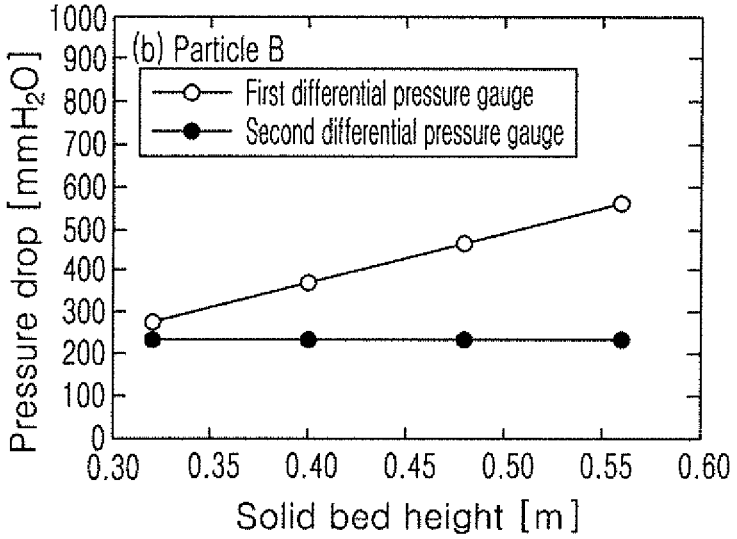
Figure 7C:
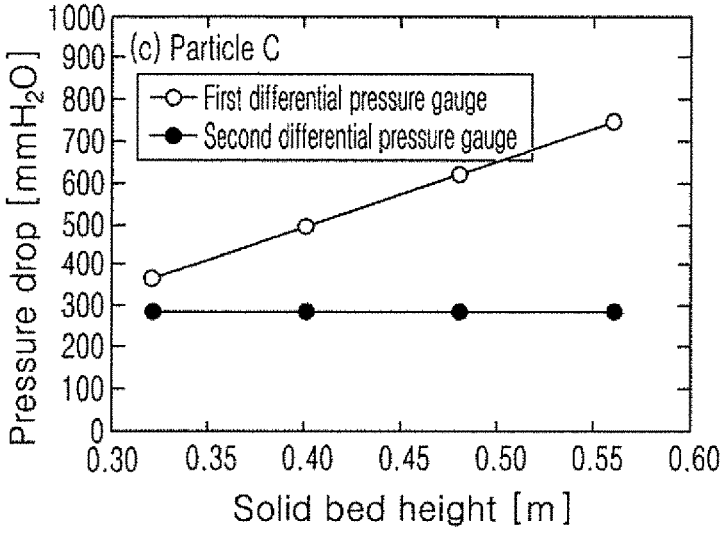

FIGS. 7*a* to 7*c* are graphs showing changes in measured values by the first differential pressure measuring part and the second differential pressure measuring part measured for three different particles according to the experimental example of the present invention.

That is, as shown in FIG. 5, the lower pressure probe 41, the middle pressure probe 42 and the upper pressure probe 43 were mounted to the fluidized bed reactor 10, the lower pressure probe 41 and the middle pressure probe 42 were connected to the first differential pressure gauge 20, and then, the lower pressure probe 41 and the upper pressure probe 43 were mounted to the second differential pressure gauge 30. FIGS. 7*a* to 7*c* illustrate changes in pressure drops measured by the first differential pressure gauge 20 and the second differential pressure gauge 30 according to changes in height of the solid bed.

The experiment was carried out in the acrylic fluidized bed reactor 10 with an inner diameter of 0.1 m and a height of 1.2 m at room temperature and pressure, and the real height of the solid bed was measured using a transparent wall of the fluidized bed. The lower pressure probe 41 of the (+) side was mounted to the first differential pressure gauge 20 at the height of 0.1 m from the gas distributor 1 and the middle pressure probe 42 of the (−) side was mounted to the first differential pressure gauge 20 at the height of 0.3 m from the gas distributor 1, and the lower pressure probe 41 of the (+) side was mounted to the second differential pressure gauge 30 at the height of 0.1 m from the gas distributor 1 and the upper pressure probe 43 of the (−) side was mounted to the second differential pressure gauge 30 at the height of 1.15 m, so that the first differential pressure gauge 20 and the second differential pressure gauge 30 measured a differential pressure.

In the experiment, a particle A, a particle B and a particle C of three kinds were used, and the particle sizes and particle densities of the particles are shown in the following Table 1.

TABLE 1

| Particle | Particle Size [μm] | Particle Density [kg/m$^3$] |
|---|---|---|
| Particle A | 10~125 | 1384 |
| Particle B | 106~212 | 2481 |
| Particle C | 106~212 | 3308 |

As shown in FIGS. 7*a* to 7*c*, the particles of the three kinds showed the tendency to keep the first differential pressure value, which was measured by the first differential pressure gauge 20 immersed in the solid bed, uniform even though the entire height of the solid bed inside the fluidized bed was increased and to increase the second differential pressure value, which corresponds to the entire height of the solid bed measured by the second differential pressure gauge 30, linearly as the height of the solid bed increased.

Therefore, if the previously known height (H1) and the first differential pressure value (ΔP1) measured by the first differential pressure gauge 20 are inputted in the mathematical formula 4 to determine the height arithmetic constant value (a), the height (H2) can be obtained when the height arithmetic constant value (a) and the second differential pressure value (ΔP2) are inputted in the mathematical formula 5.

Figure 8:
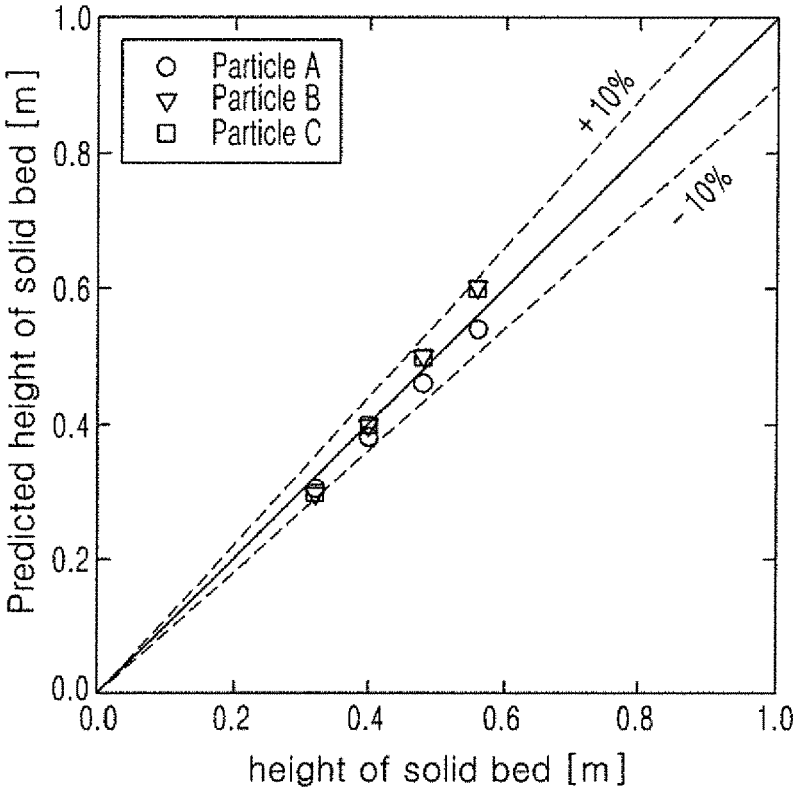
FIG. 8 is a graph showing a comparison between the real height of the solid bed and the height of the solid bed predicted by the experimental example of the present invention.
Figure 9:
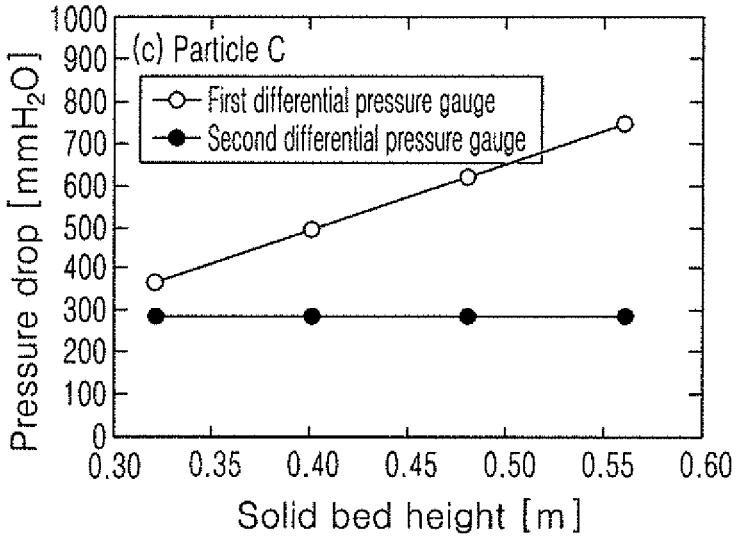
Figure 10:
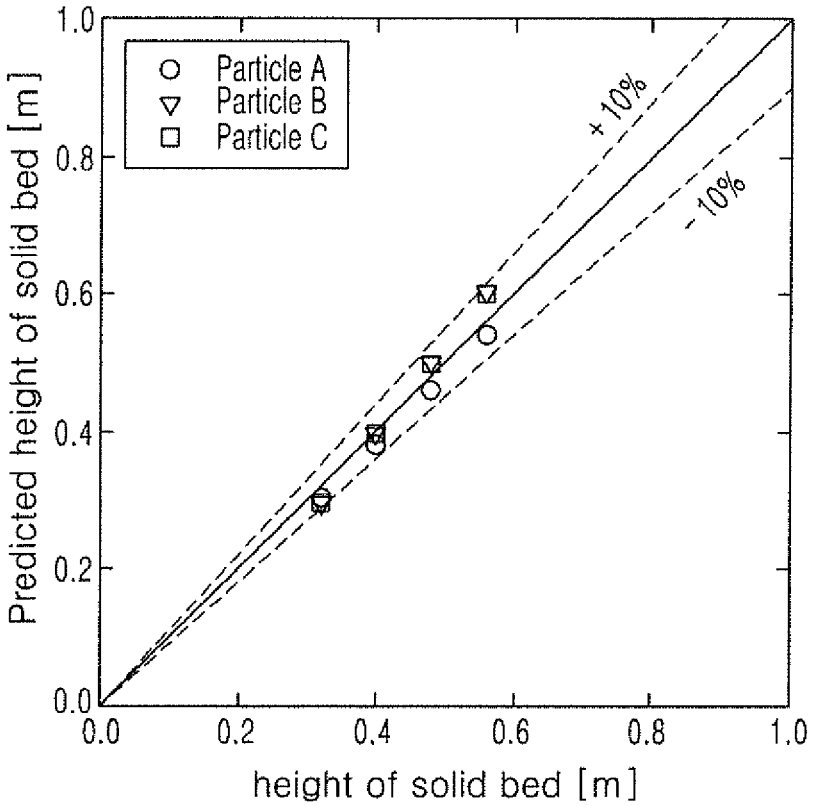

FIG. 8 is a graph showing a comparison of the height of the solid bed predicted by the experimental example of the present invention. That is, FIG. 8 illustrates comparison between the height of the solid bed calculated through the mathematical formulas 4 and 5 and the real height of the solid bed charged in the fluidized bed.

In this experiment, the real height of the solid bed which was accumulated inside the fluidized bed having the transparent wall surface was directly measured from the wall surface. In the drawing, the X-axis means the real height of the solid accumulated inside the fluidized bed and the Y-axis means the height of the solid bed predicted by the first differential pressure gauge 20 and the second differential pressure gauge 30. As shown in the drawing, for all three particles, the height of the solid bed could be predicted within a range of ±10%.

An explanation of the reference numerals used in drawings is provided as follows: 1: Gas distributor, 2: Gas introducing chamber, 3: Gas injection means or gas injector, 4: Temperature sensor, 5: Pressure probe, 6: Differential pressure gauge, 10: Fluidized bed reactor, 20: First differential pressure gauge, 30: Second differential pressure gauge, 41: Lower pressure probe, 42: Middle pressure probe, 43: Upper pressure probe, 50: Differential pressure type pressure converter, 100: High-temperature and high-pressure fluidized bed system having a solid bed height measuring apparatus.

While the present invention has been particularly shown and described with reference to the embodiments thereof, it will be understood by those of ordinary skill in the art that the present invention is not restricted to the embodiments and all or some of the embodiments may be selectively combined together in order to make various changes, modification and equivalences within the technical scope of the present invention.

What is claimed is:

1. A solid bed height measuring apparatus in a high-temperature and high-pressure fluidized bed system comprising:

a lower pressure probe which is mounted at an upper side as high as a first height from a gas distributor of a fluidized bed reactor to measure pressure of the mounted location;

a middle pressure probe which is mounted at an upper side as high as a second height from the lower probe to measure pressure of the mounted location;

an upper pressure probe which is mounted at the top of the fluidized bed reactor to measure the inside pressure of the fluidized bed reactor;

the lower pressure probe and the middle pressure probe being mounted to exist inside the solid bed under all operation conditions, and the upper pressure probe being mounted at the upper side of the fluidized bed reactor, where the solid bed cannot reach, under all operation conditions;

a first differential pressure gauge for measuring a first differential pressure value (ΔP1) which is differential pressure between a first pressure value measured by the lower pressure probe and a second pressure value measured by the middle pressure probe;

a second differential pressure gauge for measuring a second differential pressure value (ΔP2) which is differential pressure between a first pressure value measured by the lower pressure probe and a third pressure value measured by the upper pressure probe; and a height arithmetic part for calculating a height of the solid bed inside the fluidized bed reactor based on the first differential pressure value (ΔP1) and the second differential pressure value (ΔP2), wherein the height arithmetic part calculates:

a height arithmetic constant value (a)

$$a = \frac{g_c}{(1-\varepsilon_{mf})(\rho_s-\rho_g)g}$$

(wherein εmf is a voidage of the solid bed under the minimum fluidization condition, ρs is density of the solid, ρg is density of the gas, gc is a gravitational acceleration constant, and g is acceleration of gravity) from the first differential pressure value and the second height (H1) on the basis of the mathematical formula:

$H1=a\Delta P1$;

a height (H2) of the solid bed existing at the upper pressure probe from the height arithmetic constant value (α) and the second differential pressure value (ΔP2) on the basis of the mathematical formula:

$H2=a\Delta P2$; and a height (HS) of the solid bed in a high-temperature and high-pressure fluidized bed system from the height (H2) of the solid bed existing at the upper pressure probe and the first height (H0) on the basis of the mathematical formula $HS=H0+H2$.

2. The solid bed height measuring apparatus according to claim 1, further comprising:

a display part for displaying the first pressure value, the second pressure value, the third pressure value, the first differential pressure value, the second differential pressure value and the height of the solid bed in real time.

3. A solid bed height measuring apparatus in a high-temperature and high-pressure fluidized bed system comprising:

a lower pressure probe which is mounted at an upper side as high as a first height from a gas distributor of a fluidized bed reactor to measure pressure of the mounted location;

a middle pressure probe which is mounted at an upper side as high as a second height from the lower probe to measure pressure of the mounted location;

an upper pressure probe which is mounted at the top of the fluidized bed reactor to measure the inside pressure of the fluidized bed reactor;

the lower pressure probe and the middle pressure probe being mounted to exist inside the solid bed under all operation conditions, and the upper pressure probe being mounted at the upper side of the fluidized bed reactor, where the solid bed cannot reach, under all operation conditions;

a differential pressure type pressure converter for measuring differential pressure values based on a first pressure value measured by the lower pressure probe, a second pressure value measured by the middle pressure probe and a third pressure value measured by the upper pressure probe, the different pressure type converter measuring a first differential pressure value (ΔP1) which is a differential pressure between the first pressure value and the second pressure value, and a second differential pressure value (ΔP2) which is a differential pressure between the first pressure value and the third pressure value; and a height arithmetic part for calculating a height of the solid bed inside the fluidized bed reactor based on the first differential pressure value (ΔP1) and the second differential pressure value (ΔP2);

wherein the height arithmetic part calculates:

a height arithmetic constant value (a)

$$a = \frac{g_c}{(1-\varepsilon_{mf})(\rho_s-\rho_g)g}$$

(wherein εmf is a voidage of the solid bed under the minimum fluidization condition, ρs is density of the solid, μg is density of the gas, gc is a gravitational acceleration constant, and g is acceleration of gravity) from the first differential pressure value and the second height (H1) based on the mathematical formula:

$H1=a\Delta P1$;

a height (H2) of the solid bed existing at the upper pressure probe from the height arithmetic constant value (α) and the second differential pressure value (ΔP2) based on the mathematical formula:

$H2=a\Delta P2$; and a height (HS) of the solid bed in a high-temperature and high-pressure fluidized bed system from the height (H2) of the solid bed existing at the upper pressure probe and the first height (H0) based on the mathematical formula:

$HS=H0+H2$.

4. The solid bed height measuring apparatus according to claim 3, further comprising:

a display part for displaying the first pressure value, the second pressure value, the third pressure value, the first differential pressure value, the second differential pressure value and the height of the solid bed in real time.

5. A solid bed height measuring method inside a fluidized bed reactor comprising:

mounting a lower pressure probe at an upper side as high as a first height from a gas distributor of a fluidized bed reactor, mounting a middle pressure probe at an upper side as high as a second height from the lower probe and mounting an upper pressure probe at the top of the fluidized bed reactor, wherein the lower pressure probe and the middle pressure probe are mounted to exist inside the solid bed under all operation conditions, and the upper pressure probe is mounted at the upper side of the fluidized bed reactor, where the solid bed cannot reach, under all operation conditions;

injecting fluidization gas into a gas introducing chamber below the gas distributor;

measuring pressure values by the lower pressure probe, the middle pressure probe and the upper pressure probe;

measuring a first differential pressure value (ΔP1), which is a differential pressure between a first pressure value measured by the lower pressure probe and a second pressure value measured by the middle pressure probe, and a second differential pressure value (ΔP2), which is a differential pressure between the first pressure value measured by the lower pressure probe and a third pressure value measured by the upper pressure probe, by a differential pressure type pressure converter; and operating a height arithmetic part for calculating a height of the solid bed inside the fluidized bed reactor based on the first differential pressure value (ΔP1) and the second differential pressure value (ΔP2), by at least calculating height arithmetic constant value (α)

$$a = \frac{g_c}{(1-\varepsilon_{mf})(\rho_s-\rho_g)g}$$

(wherein εmf is a voidage of the solid bed under the minimum fluidization condition, ρs is density of the solid, μg is density of the gas, gc is a gravitational acceleration constant, and g is acceleration of gravity) from the first differential pressure value and the second height (H1) based on the mathematical formula:

$$H1=a\Delta P1;$$

a height (H2) of the solid bed existing at the upper pressure probe from the height arithmetic constant value (α) and the second differential pressure value (ΔP2) based on the mathematical formula:

$$H2=a\Delta P2; \text{ and}$$

a height (HS) of the solid bed in a high-temperature and high-pressure fluidized bed system from the height (H2) of the solid bed existing at the upper pressure probe and the first height (H0) based on the mathematical formula:

$$HS=H0+H2.$$

* * * * *